US010374354B2

(12) United States Patent
Ehrensvärd

(10) Patent No.: US 10,374,354 B2
(45) Date of Patent: Aug. 6, 2019

(54) USB-C PLUG WITH SURFACE MOUNT CONTACT POINTS

(71) Applicant: Yubico AB, Stockholm (SE)

(72) Inventor: Jakob Ehrensvärd, Palo Alto, CA (US)

(73) Assignee: YUBICO AB, Stockholm (SE)

( * ) Notice: Subject to any disclaimer, the term of this patent is extended or adjusted under 35 U.S.C. 154(b) by 0 days.

(21) Appl. No.: 16/119,963

(22) Filed: Aug. 31, 2018

(65) Prior Publication Data

US 2019/0067853 A1 Feb. 28, 2019

Related U.S. Application Data

(60) Provisional application No. 62/552,763, filed on Aug. 31, 2017.

(51) Int. Cl.

| | |
|---|---|
| ***H01R 13/627*** | (2006.01) |
| ***H01R 12/71*** | (2011.01) |
| ***H01R 13/66*** | (2006.01) |
| ***H01R 24/62*** | (2011.01) |
| ***H01R 12/70*** | (2011.01) |
| ***H01R 13/20*** | (2006.01) |
| ***H01R 13/6582*** | (2011.01) |
| *H01R 12/57* | (2011.01) |

(Continued)

(52) U.S. Cl.

CPC ..... *H01R 13/6273* (2013.01); *H01R 12/7005* (2013.01); *H01R 12/716* (2013.01); *H01R 13/20* (2013.01); *H01R 13/6582* (2013.01); *H01R 13/6683* (2013.01); *H01R 24/62* (2013.01); *H01R 12/57* (2013.01); *H01R 12/735* (2013.01); *H01R 13/6275* (2013.01); *H01R 24/60* (2013.01); *H01R 2107/00* (2013.01)

(58) Field of Classification Search

CPC ..... H01R 13/6273

See application file for complete search history.

(56) References Cited

U.S. PATENT DOCUMENTS

| | | | |
|---|---|---|---|
| 6,315,584 | B1 | 11/2001 | Greenside et al. |
| 8,000,502 | B2 | 8/2011 | Dave et al. |

(Continued)

OTHER PUBLICATIONS

PCT International Search Report and Written Opinion, PCT Application No. PCT/US18/49246, dated Nov. 30, 2018, 16 pages.

*Primary Examiner* — James Harvey

(74) *Attorney, Agent, or Firm* — Fenwick & West LLP

(57) ABSTRACT

A universal serial bus type-C (USB-C) plug includes a barrel, signal contacts, retention latches, and a surface mounting assembly. The barrel has an insertion end, a contact end opposite the insertion end, and a pair of long sides and a pair of short sides between the contact end and the insertion end. The signal contacts and retention latches are arranged within the barrel, the signal contacts along the long sides, and the retention latches along the short sides. The surface mounting assembly is connected to the contact end of the barrel and includes surface mount contact points each connected to a respective signal contact, and retention latch contact points each connected to a respective retention latch. Each surface mount contact point extends substantially perpendicular to the signal contacts, and each retention latch contact point extends substantially perpendicular to the retention latches and to the surface mount contact points.

17 Claims, 7 Drawing Sheets

(51) Int. Cl.

| | |
|---|---|
| *H01R 107/00* | (2006.01) |
| *H01R 12/73* | (2011.01) |
| *H01R 24/60* | (2011.01) |

(56) References Cited

U.S. PATENT DOCUMENTS

| | | | | |
|---|---|---|---|---|
| 9,502,821 | B2 * | 11/2016 | Little | H01R 13/6582 |
| 9,917,455 | B1 * | 3/2018 | Shipman | H02J 7/0044 |
| 10,205,257 | B1 * | 2/2019 | Li | H01R 13/6593 |
| 2010/0041265 | A1 * | 2/2010 | Wang | H01R 13/6273<br>439/353 |
| 2012/0253607 | A1 * | 10/2012 | Choi | B60R 25/25<br>701/49 |
| 2013/0078831 | A1 | 3/2013 | Chiu et al. | |
| 2015/0171562 | A1 * | 6/2015 | Gao | H01R 13/6582<br>439/345 |
| 2015/0229073 | A1 * | 8/2015 | Katayanagi | H01R 13/6275<br>439/345 |
| 2016/0156114 | A1 | 6/2016 | Kao et al. | |
| 2016/0344122 | A1 | 11/2016 | Kao et al. | |
| 2017/0110812 | A1 | 4/2017 | Tsai et al. | |
| 2017/0125944 | A1 | 5/2017 | Yokoyama | |
| 2017/0194749 | A1 | 7/2017 | Little et al. | |
| 2019/0013603 | A1 * | 1/2019 | Azad | H01R 12/57 |
| 2019/0067853 | A1 * | 2/2019 | Ehrensvard | H01R 12/716 |

* cited by examiner

USB-C PLUG WITH SURFACE MOUNT CONTACT POINTS

CROSS-REFERENCE TO RELATED APPLICATIONS

This application claims the benefit of U.S. Provisional Application No. 62/552,763, filed on Aug. 31, 2017, which is hereby incorporated by reference in its entirety.

BACKGROUND

The present disclosure generally relates to a USB-C plug with surface mount contact points for mounting to a printed circuit board (PCB).

Universal Serial Bus (USB) Type-C (referred to as "USB-C") is a connector system for transporting data and power between devices. A USB-C connection is formed when a plug is inserted into a receptacle. The USB-C plug is becoming more popular and has been integrated into many types of devices. However, the size of available USB-C plugs makes it difficult to create small devices with USB-C plugs.

SUMMARY

A universal serial bus (USB) plug with a small form factor is described herein. The USB plug has a barrel with an insertion end for inserting into a USB receptacle, and a contact end that is opposite the insertion end. A barrel direction is defined as extending from the contact end to the insertion end. The USB plug has a set of signal contacts that arranged within the barrel and are substantially parallel to the barrel direction. According to the USB Type-C Specification, up to twelve signal contact points are arranged along each of the long sides inside the barrel. The plug also has a surface mounting assembly that includes a set of surface mount contact points each connecting to a respective one of the signal contacts. The surface mount contact points are substantially perpendicular to the plurality of signal contacts. In other words, each of the signal contacts extends out of the contact end of the barrel, and the extension is bent at a 90 degree (or approximately 90 degree) angle relative to the signal contacts inside the barrel. Each of these bent extensions forms a surface mount contact point. The surface mount contact points can be connected a printed circuit board (PCB) that has a surface perpendicular to the barrel direction.

In some embodiments, the surface mounting assembly includes a housing that has an inner portion extending into the barrel and an outer portion extending outside the barrel. The outer portion of the housing has a bottom surface that is perpendicular to the barrel direction. The signal contacts are housed in the inner portion of the housing. A first subset of the surface mount contact points extend out of a first side of the outer portion of the housing, and a second subset of the surface mount contact points extend out of a second side of the outer portion of the housing that is opposite the first side of the outer portion of the housing. The surface mounting assembly may also include two alignment pins located on opposite corners of the bottom surface of the outer portion of the housing.

In some embodiments, the USB plug also includes a pair of retention latches arranged within the inner portion of the housing substantially parallel to the barrel direction. According to the USB Type-C Specification, a retention latch is arranged along each of the short inner sides of the barrel. The retention latches may extend into the outer portion of the housing. Two retention latch contact points may extend out of two opposite sides of the outer portion of the housing. The retention latch contact points each connect to a respective one of the retention latches, and the retention latch contact points are substantially perpendicular to retention latches.

In some embodiments, the USB plug is connected to a PCB. In particular, the surface mount contact points are connected to bonding pads on a PCB. The retention latch contact points can also be connected to additional bonding pads on the PCB.

DETAILED DESCRIPTION

USB Type-C, or USB-C, is a standardized connector system for transporting data and power between devices. The insertable USB-C plug is horizontally symmetrical and reversible. A connection can be made between the insertable plug and a receptacle that accepts the plug. The receptacle and the plug can each have up to 24 pins, but one or both may have fewer pins if fewer connections are needed for the device including the receptacle, or for a device including the plug.

Figure 1:
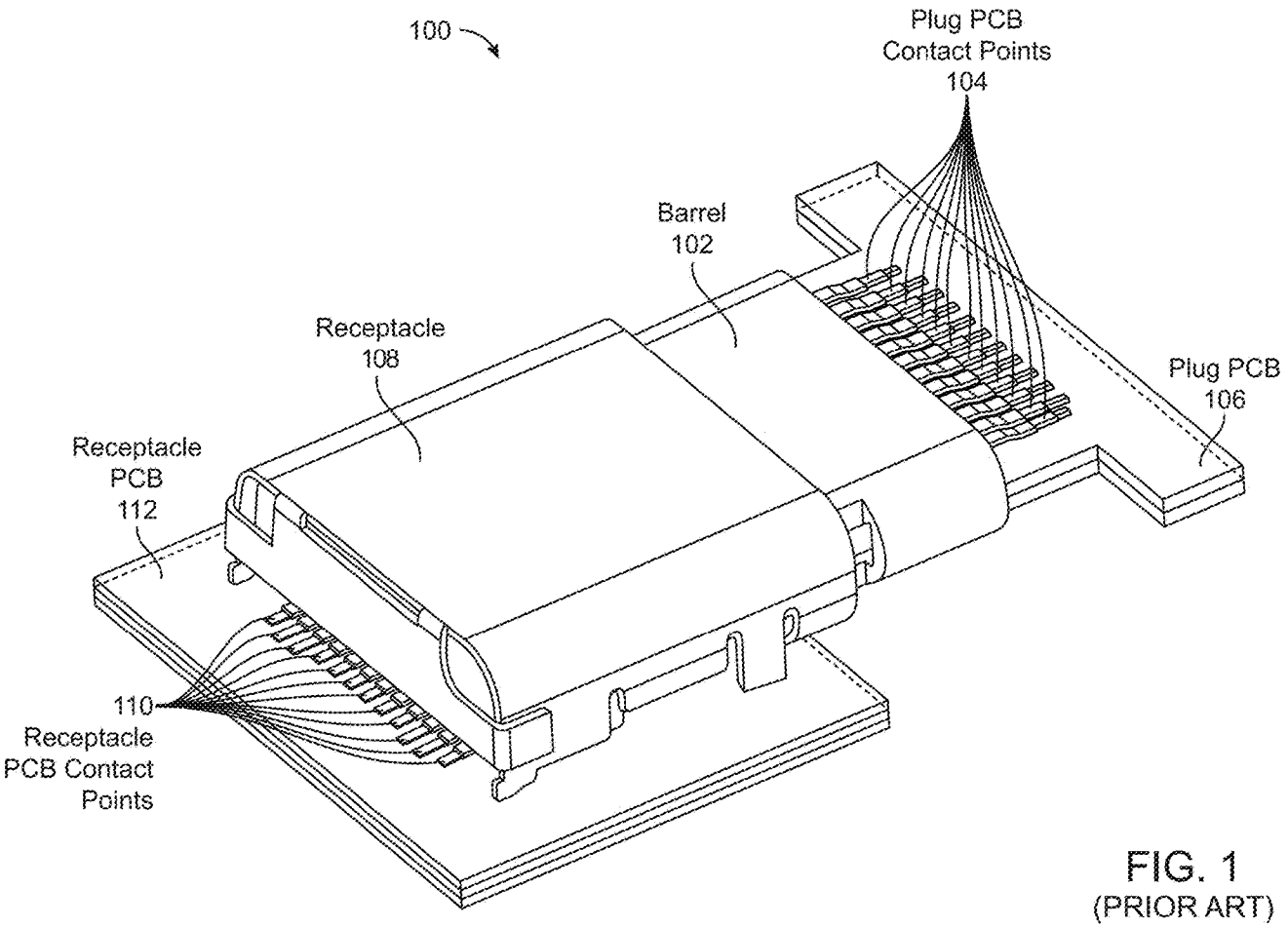
FIG. 1 (PRIOR ART)
FIG. 1 shows a prior art USB-C plug and receptacle.

FIG. 1 shows a prior art USB-C plug and receptacle assembly 100. The USB-C plug has a barrel 102, which connects to a plug printed circuit board (PCB) via plug PCB contact points 104. A row of twelve plug PCB contact points 104 extends from the upper side of the barrel 102, which is visible in FIG. 1. A second row of plug PCB contact points (not shown) extends from the lower side of the barrel 102, such that the two rows of contact points straddle an edge of a plug PCB 106. The upper row of plug PCB contact points 104 connect to the upper side of the plug PCB 106, and the lower row of plug PCB contact points (not shown) connect to the lower side of the plug PCB 106.

The barrel 102 is shown partially inserted into the receptacle 108, which connects to a receptacle PCB 112 via receptacle PCB contact points 110. The plug PCB contact points 104 extend inside the barrel, where they are referred to as signal contacts (not shown); similarly, the receptacle PCB contact points 110 extend inside the receptacle 108 as signal contacts (not shown). When the barrel 102 is inserted into the receptacle 108, the signal contacts within the barrel 102 and the signal contacts within the receptacle 108 connect, so that data signals and power can be exchanged between the plug PCB 106 and the receptacle PCB 112.

As shown in FIG. 1, the plug PCB contact points 104 extend nearly straight out from the barrel 102, and the plug PCB 106 extends beyond the length of the plug PCB contact points 104. While this form is acceptable for some use cases, such as USB-C cables or large memory sticks, in other cases, it would be desirable to have a plug with a smaller form factor that does not require the plug PCB contact points 104 and the plug PCB 106 to extend as far out from the barrel 102 as the embodiment shown in FIG. 1. In addition, in some cases it would be preferable to connect the USB-C plug to a PCB that is oriented perpendicular to the barrel 102, rather than parallel to the barrel 102 as in FIG. 1.

FIGS. 2-8 show various views of a USB-C plug that supports perpendicular contacts for connecting the USB-C plug to a PCB that is oriented perpendicular to its barrel. These perpendicular contacts do not extend out from the end of the barrel, giving the USB-C plug shown in FIGS. 2-8 a smaller form factor than the USB-C plug shown in FIG. 1.

Figure 2:
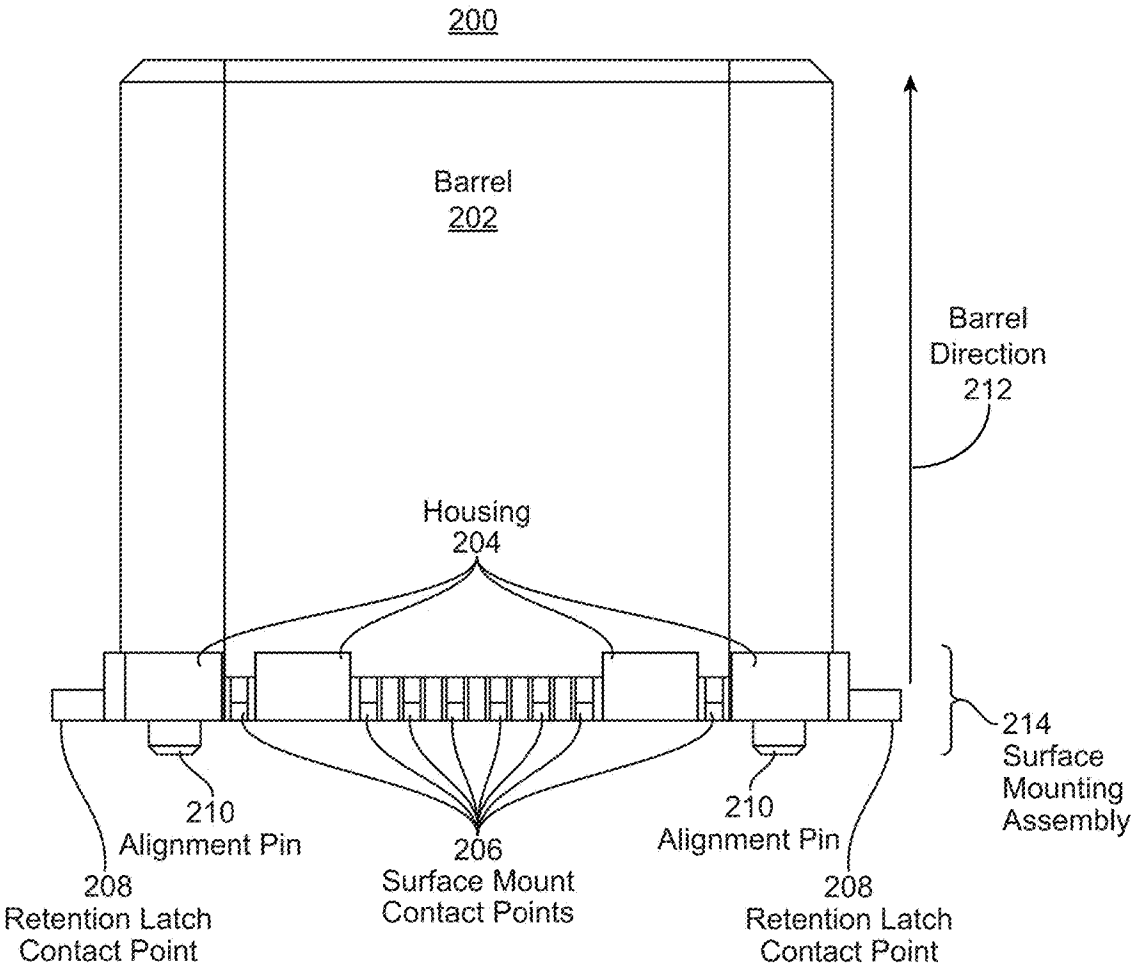
FIG. 2 shows a front view of a USB-C plug for mounting to a printed circuit board, in one embodiment.

FIG. 2 shows a front view 200 of a USB-C plug for mounting to a circuit board, in one embodiment. The USB-C plug has a barrel 202 and a surface mounting assembly 214, which includes a housing 204, surface mount contact points 206, retention latch contact points 208, and alignment pins 210.

The barrel 202 can be inserted into a receptacle, such as receptacle 108 of FIG. 1. FIG. 2 shows a reference barrel direction 212 that extends from the bottom of the barrel 202 (referred to herein as the contact end) to the top of the barrel 202 (referred to herein as the insertion end). The insertion end of the barrel 202 is the end that can be inserted into a receptacle. The barrel 202 may be made of any strong, rigid material, such as stainless steel or phosphor bronze. The barrel 202 is hollow, and the inside of the barrel 202 includes signal contacts (not shown in FIG. 2) and retention latches (not shown in FIG. 2) that each extend along the inside of the barrel 202 in the barrel direction 212. While the barrel 202 is shown as having an angled rim at the insertion end, the shape of the rim may be different, e.g., the rim may be flat across the top.

Figure 5:
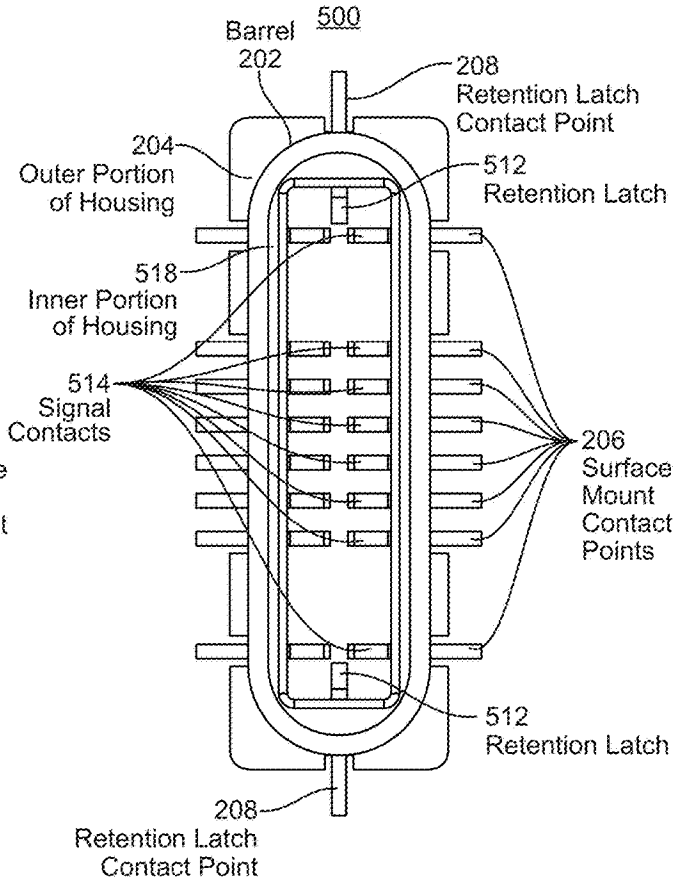
FIG. 5 shows a top view of a USB-C plug for mounting to a printed circuit board, in one embodiment.
Figure 7:
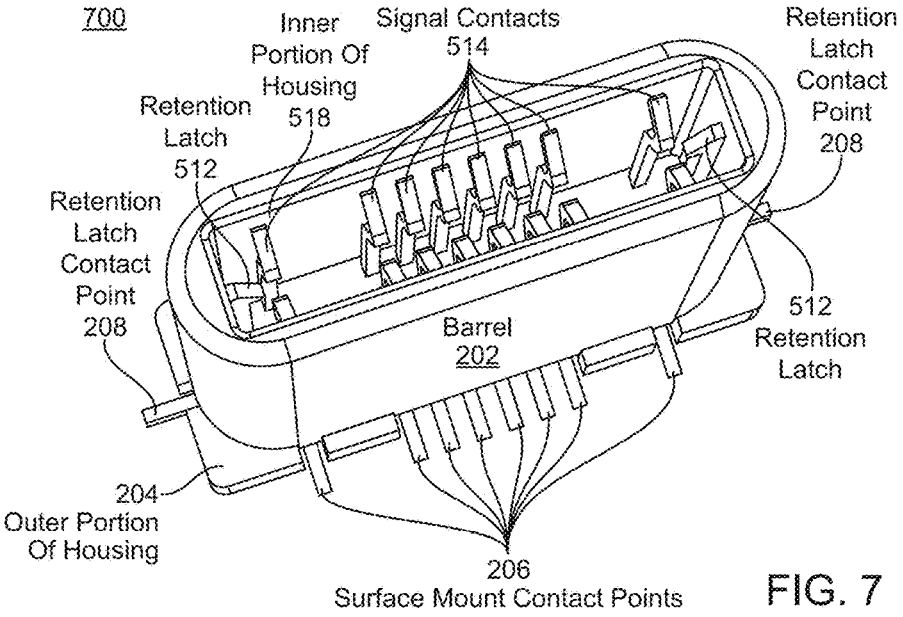
FIG. 7 shows a perspective view of the top and front of a USB-C plug for mounting to a printed circuit board, in one embodiment.

At the contact end of the barrel 202 is a housing 204. The housing 204 connects to the barrel 202 and provides a structure for the surface mounting assembly 214, which also includes the surface mount contact points 206, retention latch contact points 208, and alignment pins 210. In some embodiments, the portion of the housing 204 shown in FIG. 2 is an outer portion, and the USB-C plug also has an inner portion of the housing that extends inside the barrel 202 and is enclosed by the barrel 202. In such embodiments, the inner portion of the housing houses the signal contacts and retention latches. The inner portion of the housing is shown in FIGS. 5 and 7, described below. The housing 204 (including the outer portion, the inner portion, or both) may be constructed of a plastic material, e.g., a thermoplastic or synthetic resin that can withstand the heat used to solder the plug to a PCB.

The surface mount contact points 206 extend out of the side of the housing 204 that is shown in FIG. 2. In the embodiment shown in FIG. 2, there is a central set of six surface mount contact points, and an outer pair of two surface mount contact points that are separated from the central set of surface mount contact points by a gap. The surface mount contact points are described further with respect to FIG. 3.

Figure 9:
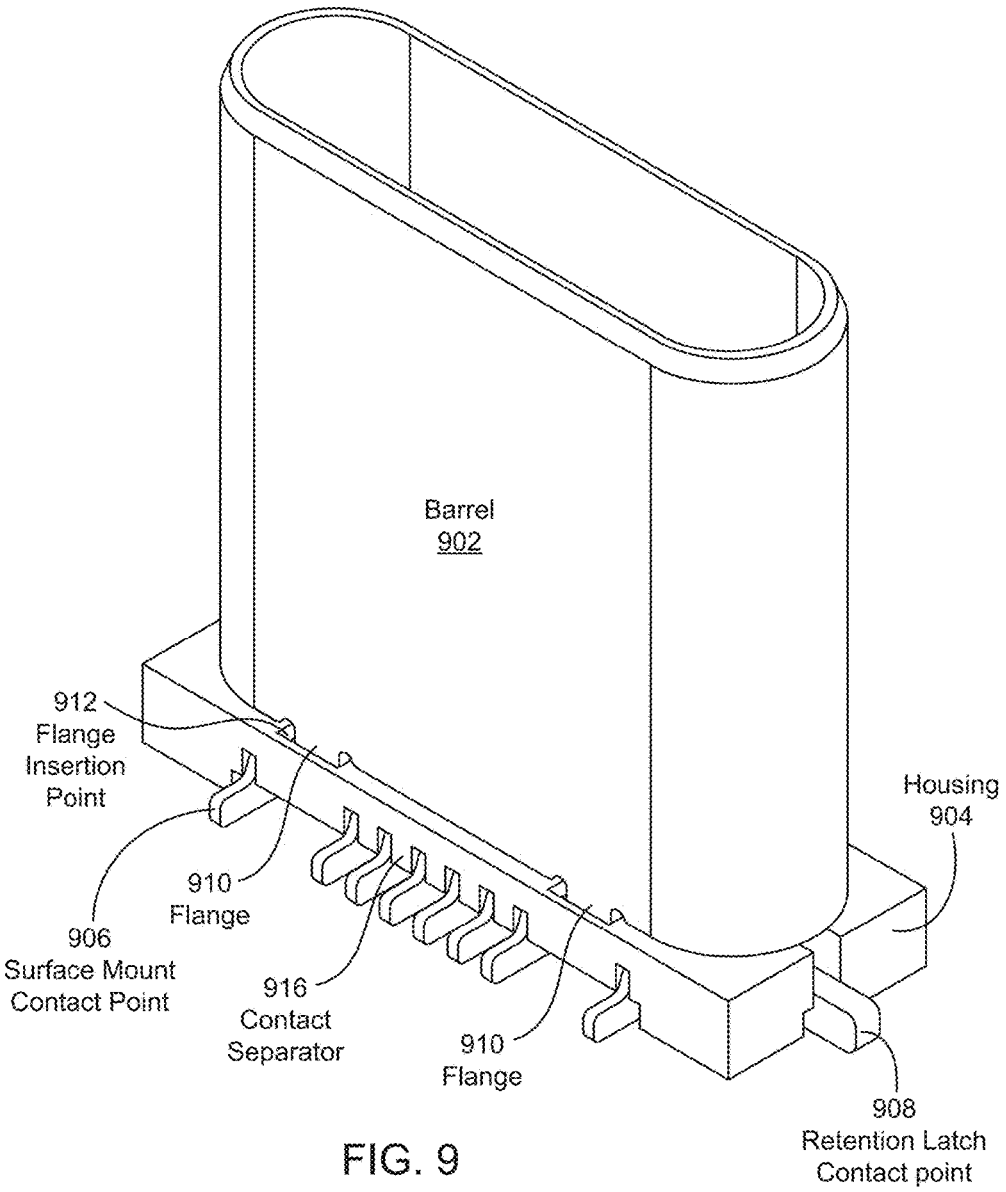
FIG. 9 shows an alternate USB-C plug for mounting to a printed circuit board having flanges for connecting the barrel to the housing, in one embodiment.

In some embodiments, the barrel 202 contains one or more flanges for connecting the barrel 202 to the housing 204. For example, the barrel 202 has four flanges, two on each of the contact ends of the long sides shown in FIG. 2, that insert into corresponding holes in the housing 204. The flanges may be positioned in the gaps between the central set of surface mount contact points and the outer surface mount contact points. The flange may extend through the housing 204 and be bent at the base of the housing 204 to hold the barrel 202 and the housing 204 together. For example, an embodiment of the barrel and housing showing connecting flanges is shown in FIG. 9.

Figure 8:
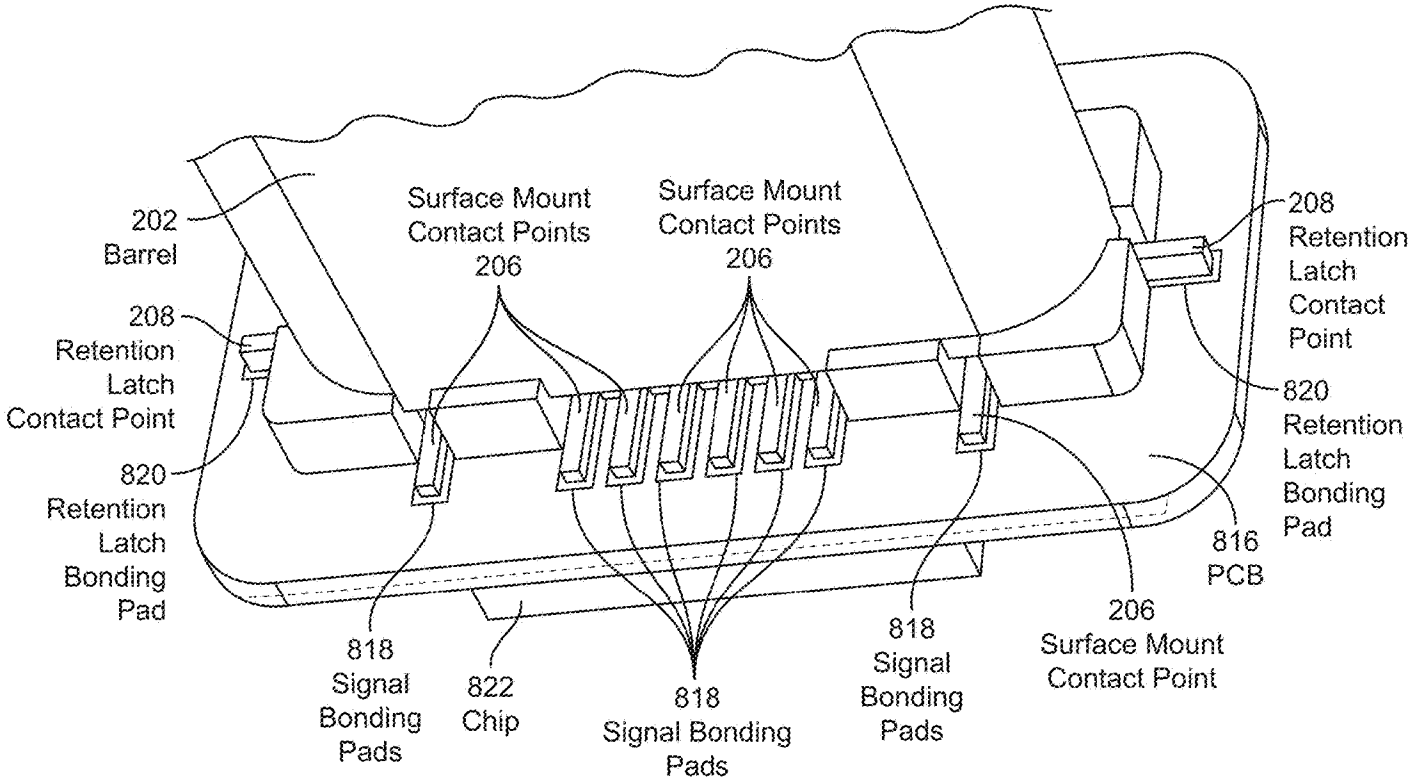
FIG. 8 shows a USB-C plug mounted onto a printed circuit board, in one embodiment.

Two retention latch contact points 208 extend out of the housing 204. The retention latch contact points 208 connect to the retention latches (shown in FIGS. 5 and 7), which extend into the barrel 202 along the barrel direction 212. The retention latch contact points 208 extend in a direction that is perpendicular to both the barrel direction 212 and the surface mount contact points 206. The retention latch contact points 208 may be made of a metal such as stainless steel. The retention latch contact points 208 can be connected to the PCB, as shown in FIG. 8. When the retention latches are inserted into a receptacle, they are typically grounded and not used to pass data or power between the plug and the receptacle. So, while the retention latch contact points 208 are not used for data or power transfer, they can be connected to the PCB to increase the bond strength between the plug and the PCB, and to enhance the stability of the connection between the plug and the PCB. The retention latches themselves provide spring tension to the receptacle to hold the USB-C plug in place when it is plugged into a receptacle of another device.

Two alignment pins 210 extend from the bottom of the housing 204. The alignment pins 210 are used to align the plug with the PCB, which may have holes or depressions that line up with the alignment pins 210 so that the housing 204 (and, therefore, the USB-C plug) can attach to the PCB at the proper position. If the housing 204 is molded as a unitary piece, e.g., using injection molding, the alignment pins 210 may be part of the mold and composed of the same material (e.g., a thermoplastic). Alternatively, the alignment pins 210 may be formed separately and attached to the housing 204.

Figure 3:
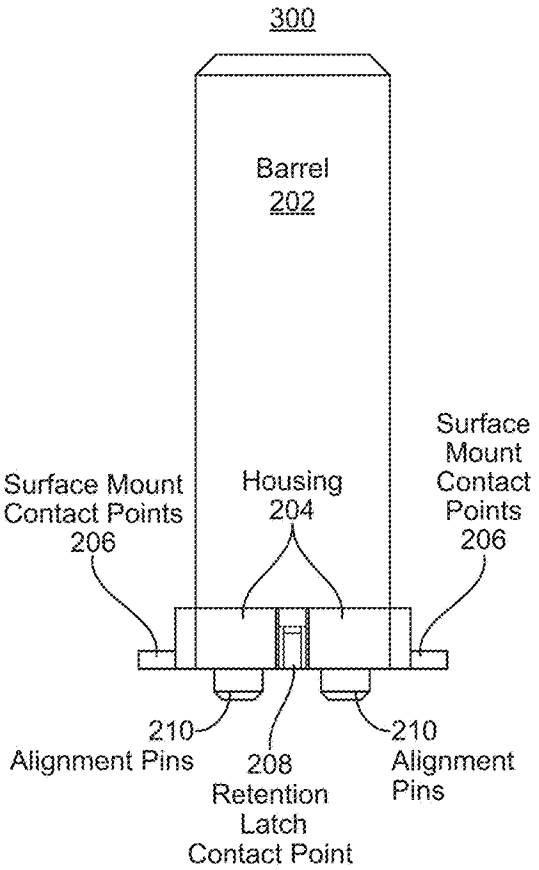
FIG. 3 shows a side view of a USB-C plug for mounting to a printed circuit board, in one embodiment.

FIG. 3 shows a side view 300 of the USB-C plug for mounting to a circuit board shown in FIG. 2. The side of the barrel 202 shown in FIG. 2 is referred to as a long side, and the side of the barrel 202 shown in FIG. 3 is referred to as a short side. The retention latch contact point 208 connects to the retention latch (not shown) that is positioned along the short side of the barrel 202. The surface mount contact points 206 connect to signal contacts (not shown) that are positioned along the long sides of the barrel 202.

As shown in FIG. 3, there are two sets of surface mount contact points 206, one set along each long side of the barrel 206. The surface mount contact points 206 connect to the signal contacts (shown in FIGS. 5 and 7), which extend into the barrel 202 along the barrel direction 212. The surface mount contact points 206 extend in a direction substantially perpendicular to the retention latch contact points 208 and substantially perpendicular to the signal contacts and the barrel direction 212. The surface mount contact points 206 can be connected to a printed circuit board (PCB), as shown in FIG. 8. The surface mount contact points 206 may be a conductive, tarnish-resistant material such as a gold-coated metal. For example, the surface mount contact points 206 may be made of gold-coated nickel, or gold-coated copper alloy.

Figure 4:
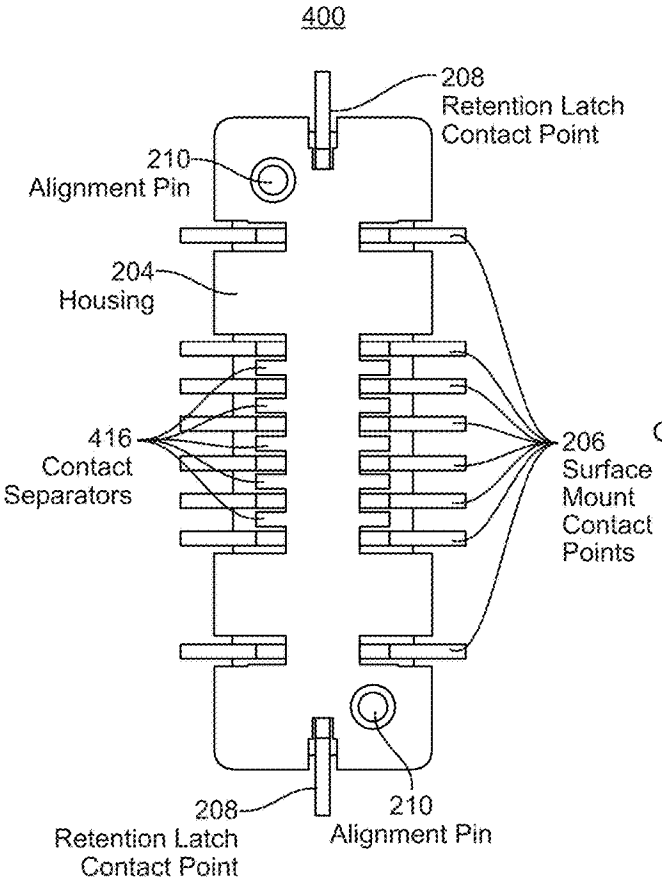
FIG. 4 shows a bottom view of a USB-C plug for mounting to a printed circuit board, in one embodiment.

FIG. 4 shows a bottom view 400 of the USB-C plug shown in FIGS. 2 and 3. The bottom surface of the housing 204 is shown in FIG. 4 as having a curved rectangular shape with a number of cut-outs for the surface mount contact points 206 and the retention latch contact points 208. The surface mount contact points 206 extend out both long sides of the housing 204, and the retention latch contact points 208 extend out both short sides of the housing 204. The housing 204 includes contact separators 416 between the surface mount contact points 206 that are arranged closely together (i.e., the middle six contact points on each side of the housing 204). As shown in FIG. 4, the contact separators 416 do not extend fully to the sides of the housing 204. This allows visual and physical access to the connections between the surface mount contact points 206 and the signal contacts. For example, keeping the contact separators 416 relatively short allows for visual inspection and repair of the surface mount contact points 206.

The two alignment pins 210 protrude from the bottom surface of the housing 204. The alignment pins 210 are located in opposite corners of the bottom surface of the housing 204. In other embodiments, more or fewer alignment pins 210 are included. In other embodiments, the alignment pins 210 are located at different locations on the housing 204.

The alignment pins 210 provide at least two mechanical advantages. First, during manufacture of a USB-C device, the alignment pins 210 guide the plug to the proper position on the PCB board it is being attached to (or vice versa). This guidance ensures that the surface mount contact points 206 and retention latch contact points 208 are aligned with and bonded to corresponding contact points on the PCB board. Second, the alignment pins 210 improve the stability and robustness of this connection. The retention latch contact points 208 and surface mount contact points 206 are soldered to corresponding contact points on the PCB to connect the plug to the PCB. The solder provides a strong bond with respect to pulling forces, which are applied to the connection when the plug is removed from a receptacle. However, a typical solder bond is less robust to shear forces. The alignment pins, which fit into corresponding holes in the PCB, allow the connection between the plug and PCB to withstand stronger shear forces than the solder alone would allow.

In one embodiment, the bottom of the housing 204 does not have a single flat surface, as shown in FIG. 4. Instead, the metal material forming the retention latch contact points 208 may extend across the bottom of the USB-C plug through its center, connecting the two retention latch contact points 208 together. Connecting the two retention latch contact points 208, and the retention latches to which the retention latch contact points 208 connect, may provide greater mechanical resilience for the USB-C plug and increase the tension on the retention latches. In addition, a strip of metal through the bottom of the housing 504 provides additional surface area for soldering the USB-C plug to a PCB, providing a stronger bond between the plug and the PCB. In this embodiment, the housing 204 may still be molded as a single injection-molded unit, e.g., the housing may encase the metal strip on three sides.

FIG. 5 shows a top view 500 of the USB-C plug shown in FIGS. 2-4. The top view 500 shows that the barrel 202 is stadium-shaped, i.e., a rectangle with semicircles at a pair of opposite sides. The top view 500 also shows that the housing includes both the outer portion 204 that is shown in FIGS. 2-4 and an inner portion 518. The outer portion of the housing 204 is located below the barrel 202, as shown in FIGS. 2-4. The inner portion of the housing 518 is enclosed by the barrel 202. The inner portion of the housing 518 and outer portion of the housing 204 may be molded as a single unit, or the inner portion of the housing 518 and outer portion of the housing 204 may be formed separately and connected. The inner portion of the housing 518 has a rounded rectangular hollow region.

The top view 500 of the USB-C plug also shows two retention latches 512 and a set of signal contacts 514. The retention latches 512 and signal contacts 514 are located inside the barrel 202 and are housed by the inner portion of the housing 518. The signal contacts 514 are also referred to as "pins." The signal contacts 514 electrically connect to corresponding contacts in a receptacle. The retention latches 512 are used to latch onto a receptacle and hold the USB-C plug in place when it is inserted into the receptacle.

As shown in FIGS. 2-5, the USB-C plug includes sixteen surface mount contact points 206 and sixteen corresponding signal contacts 514. However, other embodiments may have more or fewer surface mount contact points 206 and signal contacts 514. The USB Type-C Specification describes 24 pins (i.e., 24 signal contacts); some applications use a plug with the full set of 24 pins, and other applications use a plug with a subset of the pins. For example, in applications where data transfer at high speed is not required, fewer than 24 pins may be used.

Each retention latch 512 shown inside the inner portion of housing 518 and its corresponding retention latch contact point 508 form a single unit, and are made of the same material, such as stainless steel. During manufacture, the retention latches 512 may initially extend out of the contact end of the barrel, parallel to the barrel direction 212, and then be bent at a 90 degree (or approximately 90 degree) angle and fit into the housing 204, forming the retention latch contact points 208. Alternatively, the material forming the retention latches 512 and retention latch contact points 208 may be bent prior to being connected to the housing.

Similarly, each signal contact 514 shown inside the inner portion of housing 518 and its corresponding surface mount connection point 206 form a single unit, and are made of the same material, such gold-coated nickel, another gold-coated metal, or another conductive, tarnish-resistant material. During manufacture, the signal contacts 514 may initially extend out of the contact end of the barrel, parallel to the barrel direction 212, and then be bent at a 90 degree (or approximately 90 degree) angle and fit into the housing 204, forming the surface mount contact points 206. Alternatively, the material forming the signal contacts 514 and surface mount contact points 206 may be bent prior to being connected to the housing.

Figure 6:
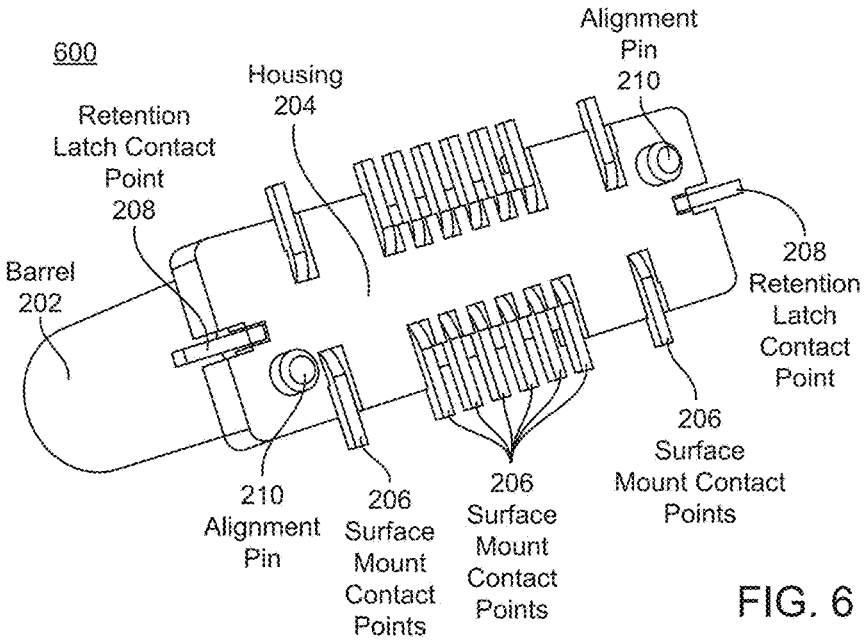
FIG. 6 shows a perspective view of the bottom and side of a USB-C plug for mounting to a printed circuit board, in one embodiment.

FIG. 6 shows a perspective view 600 of the bottom and side of the USB-C plug shown in FIGS. 2-5. The bottom/side perspective view 600 of the USB-C plug shows how the surface mount contact points 206 are bent at the connection with the signal contacts 514 which extend inside the barrel 202. The surface mount contact points 206 are at, or approximately at, a right angle (90 degrees) relative to the signal contacts, so the surface mount contact points 206 are perpendicular (or substantially perpendicular) to the signal contacts 514. Similarly, the retention latch contact points 208 are at, or approximately at, a right angle (90 degrees) relative to the retention latches 512, so the retention latch contact points 208 are perpendicular (or substantially perpendicular) to the retention latches.

FIG. 7 shows a perspective view 700 of the top and front of the USB-C plug shown in FIGS. 2-6. The top/front perspective view 700 shows the shape of the signal contacts 514 and the retention latches 512 inside the inner portion of the housing 518 and the barrel 202. In particular, it shows how the signal contacts 514 extend along the long sides of the inner portion of the housing 518 and the barrel 202 in the barrel direction 212, from the contact end towards the insertion end. The retention latches 512 extend along the short sides of the inner portion of the housing 518 and the barrel 202, from the contact end towards the insertion end. Both the signal contacts 514 and the retention latches 512 terminate with an angled portion near the insertion end, and they do not reach the insertion end.

In prior USB-C plugs, a retention latch having a similar geometry to the signal contacts can apply sufficient spring tension on the receptacle to hold the USB-C plug in place. However, in the small form factor USB-C plug shown in FIGS. 2-7, a standard retention latch structure would not apply sufficient spring tension on the receptacle. Both the bent geometry of the retention latch contact points 508, and the smaller surface area connecting the retention latch contact points 208 to the PCB, decrease the amount of spring tension that the retention latches 512 can provide. To achieve adequate spring tension, the material used to form the retention latches 512 is thicker than the signal contacts 514, and thicker than prior retention latches. It can be seen in FIGS. 2 and 3 that the retention latch contact points 208 are thicker than the surface mount contact points 206 (i.e., taller in the barrel direction 202), and in FIG. 7 that the signal contacts 514 are thinner than the retention latches 512. The geometry and material of the retention latch contact points 208 and the retention latches 512 are chosen based on mechanical requirements of the USB-C plug. In general, a thicker retention latch material for both the retention latches 512 and the retention latch contact points 208 provides greater spring tension on the retention latches.

For stainless steel retention latches 512 and retention latch contact points 508 having the geometry shown in FIGS. 2-7, the mating force (i.e., the minimum force applied to insert the USB-C plug into a receptacle) is between 5 and 20 Newtons, and the initial unmating force (i.e., the minimum force applied to remove the USB-C plug from a receptacle) is between 8 and 20 Newtons. In addition, the geometry and materials are selected such that after a fixed number of mating and unmating cycles (e.g., 10,000), the unmating force is reduced to no less than a minimum force. In this embodiment, after 10,000 cycles, the unmating force is reduced to between 6 and 20 Newtons. In this embodiment, the USB-C plug has a durability of at least 10,000 cycles.

FIG. 8 shows the USB-C plug of FIGS. 2-7 mounted onto a printed circuit board (PCB), in one embodiment. The USB-C plug is bonded to a PCB 816 at a set of signal bonding pads 818 and a pair of retention latch bonding pads 820. The signal bonding pads 818 and retention latch bonding pads are on a top surface of the PCB 816. In particular, the surface mount contact points 206, which connect to signal contacts 514 inside the barrel 202, are bonded to the signal bonding pads 818. The bond between the surface mount contact points 206 and the signal bonding pads 818 may be formed by soldering or any other electrically conductive bonding method. The retention latch contact points 208, which connect to the retention latches 512 inside the barrel 202, are bonded (using soldering or another bonding mechanism) to the retention latch bonding pads 820.

The signal bonding pads 818 are used to physically connect the surface mount contact points 806 to the PCB 816. In addition, each signal bonding pad 818 can transfer electrical signals and/or power to the surface mount contact point 806 to which it is connected, allowing the chip 822 and PCB 816 to transfer data with a device into which the USB-C plug is plugged. As discussed above, when the retention latches 512 are inserted into a receptacle, they are typically grounded and are not used to pass data or power between the plug and the receptacle. So, the retention bonding pads 820 may not electrically connect to other elements of the PCB 816 or to the chip 822; instead, the bond between the retention latch contact points 208 and the retention bonding pads 820 increases the bond strength and enhances the stability of the connection between the plug and the PCB 816.

A single chip 822 is shown mounted to the PCB 816. In other embodiments, any number of integrated circuits or other components or devices may be mounted in any arrangement to the PCB 816. The PCB 816 and other components, such as chip 822, may be included in a housing (not shown). In one embodiment, the PCB 816 and chip 822 are configured to output a one-time password for use in two-factor authentication. For example, the PCB 816 and chip 822 are housed in a small device with a touch sensor or a fingerprint sensor that receives a user input and, responsive to the user input, the device transmits the one-time password through the signal contacts 514 in the USB-C plug. The touch sensor or fingerprint sensor may be built onto the PCB 816 and extend out of the housing, resulting in a device with a small form factor. It should be understood that the plug can be used for any other applications or USB-C devices.

The USB-C plugs described herein may be manufactured by separately forming several elements of the USB-C plug (e.g., the barrel, the housing, metal forming the signal contacts and surface mount contact points, and metal forming the retention latches and retention latch contact points) and assembling these elements. After this initial assembly, the signal contacts and retention latches extend as pins straight out from the bottom surface of the housing. These pins can be cut to the proper size for the surface mount contact points and retention latch contact points, and then stamped to bend them at roughly a 90 degree angle to the signal contacts and retention latches, as shown in FIGS. 2-8. In other embodiments, the pins are first stamped and then cut to the proper length.

In some embodiments, a temporary cap is placed at the insertion end of the barrel and used to hold and maneuver the USB-C plug during the manufacturing process. The cap may be a synthetic resin, thermoplastic, or other plastic material. The cap has a portion that is fit to be inserted into the insertion end of the barrel, and a flat surface perpendicular to the barrel direction 212 that allows the USB plug to be maneuvered, e.g., by a vacuum pick up tool.

In an embodiment, after the USB-C plug is assembled, the cap is inserted into the barrel end. A vacuum pick up tool lifts the USB-C plug, solder is applied to the signal bonding pads 818 and retention latch bonding pads 820, and the vacuum tool places the USB-C plug on the PCB, with the alignment pins 210 properly aligning the USB-C plug and the PCB so that the surface mount contact points 206 bond to the signal bonding pads 818, and the retention latch contact points 208 bond to the retention latch bonding pads 820, as shown in FIG. 8. After these bonds are formed, the vacuum pick up tool, or another mechanism, removes the cap from the barrel, while the USB-C plug remains bonded to the PCB. Thus, the force sufficient to remove the cap from the barrel is great enough that the USB-C plug does not fall off the cap during transport to the PCB, but the force for removing the cap from the barrel is less than a minimum force to un-bond the USB-C plug from the PCB 816. In some embodiments, the PCB 816, chip 822, housing 204, and, optionally, a lower portion of the barrel 202 are encased by a plastic, e.g., using an injection molding process.

FIG. 9 shows an alternate embodiment of a USB-C plug for mounting to a printed circuit board. In this embodiment, USB-C plug includes a barrel 902 and a housing 904. The barrel 902 and housing 904 may have similar structure and be made of materials to the barrel 202 and housing 204 described with respect to FIGS. 2-8. However, the barrel 902 shown in FIG. 9 includes a set of flanges 910 that connect the barrel 902 to the housing 904. In particular, the barrel 902 includes four flanges 910, two on each of the long sides of the barrel 902 (two on one side are shown in FIG. 9). Each flange 910 is inserted into a corresponding flange insertion point 912 in the housing 904. To secure the flanges 910 to the housing 904, each flange 910 may be bent around the underside of the housing 904 (not shown in FIG. 9), or the flanges 910 may be secured to the housing 904 by another mechanism.

The USB-C plug shown in FIG. 9 also includes a set of surface mount contact points 906 and a pair of retention latch contact points 908. The surface mount contact points 906 are similar to the surface mount contact points 206 shown in FIGS. 2-8, and the retention latch contact points 908 are similar to the retention latch contact points 208 shown in FIGS. 2-8. The retention latch contact points 908 and surface mount contact points 906 connect to retention latches and signal contacts similar to the retention latches 512 and signal contacts 514 shown in FIGS. 5 and 7, and the housing 904 may include alignment pins similar to the alignment pins 210 shown in FIGS. 2-4 and 6.

The housing 904 includes contact separators 916 between the surface mount contact points 906. The contact separators 916 form gaps within the housing 904 through which the surface mount contact points 906 extend. Unlike the housing 204 with contact separators 416 shown in FIGS. 4 and 7, the contact separators 916 extend to the long outer sides of the housing 904. Further, the gaps between the contact separators 916 do not extend to the top of the housing 904, as they did in the embodiment shown in FIGS. 2-8. Instead, the housing 904 covers a portion of the tops of the surface mount contact points 906 that was not covered by the housing 204. While this arrangement of contact separators 916 provides less visual access to the surface mount contact points 906, it may increase the durability of the housing 904. In other embodiments, the housing 904 may also cover the top of the retention latch contact points 908.

In some embodiments, the barrel includes flanges 910 that extend into flange insertion points 912 of the housing 904, as shown in FIG. 9, but the contact separators and gaps between the surface mount contact points in the housing are configured as shown in FIGS. 2-8. Alternatively, the flanges 910 and flange insertion points 912 shown in FIG. 9 can be incorporated into the design shown in FIGS. 2-8, without incorporating the design of the contact separators 916 and gaps between the surface mount contact points 906 shown in FIG. 9.

Upon reading this disclosure, a reader will appreciate still additional alternative structural and functional designs through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope of the application.

What is claimed is:

1. A universal serial bus type-C (USB-C) plug comprising:

a barrel having an insertion end for inserting into a USB-C receptacle, a contact end opposite the insertion end, a pair of long sides between the contact end and the insertion end, a pair of short sides between the contact end and the insertion end, and a barrel direction extending from the contact end to the insertion end;

a plurality of signal contacts arranged within the barrel, along the pair of long sides of the barrel and substantially parallel to the barrel direction;

a pair of retention latches arranged within the barrel, each along a respective short side of the barrel and substantially parallel to the barrel direction; and a surface mounting assembly connected to the contact end of the barrel, the surface mounting assembly comprising a plurality of surface mount contact points each connected to a respective one of the plurality of signal contacts, a pair of retention latch contact points each connected to a respective one of the pair of retention latches, each of the surface mount contact points extending in a direction substantially perpendicular to the plurality of signal contacts, and each of the retention latch contact points extending in a direction substantially perpendicular to the pair of retention latches and substantially perpendicular to the plurality of surface mount contact points.

2. The USB-C plug of claim 1, wherein:

the plurality of surface mount contact points are configured to connect to a corresponding plurality of signal bonding pads on a top surface of a printed circuit board (PCB);

the pair of retention latch contact points are configured to connect to a corresponding pair of retention latch bonding pads on the top surface of the PCB; and the top surface of the PCB is arranged perpendicular to the barrel direction.

3. The USB-C plug of claim 1, wherein the surface mounting assembly further comprises a housing having an inner portion extending into the barrel and an outer portion extending outside the barrel, the outer portion of the housing having a bottom surface perpendicular to the barrel direction, wherein:

the plurality of signal contacts arranged within the barrel are housed in the inner portion of the housing;

a first set of the plurality of surface mount contact points extend out of a first side of the outer portion of the housing; and a second set of the plurality of surface mount contact points extend out of a second side of the outer portion of the housing that is opposite the first side of the outer portion of the housing.

4. The USB-C plug of claim 3, wherein the housing comprises:

a first alignment pin located at a first corner of the bottom surface of the outer portion of the housing; and a second alignment pin located at a second corner, opposite the first corner, of the bottom surface of the outer portion of the housing.

5. The USB-C plug of claim 4, wherein the first alignment pin and the second alignment pin are configured to be inserted into a pair of corresponding alignment holes on a printed circuit board (PCB), wherein the alignment pins provide resistance to shear force applied to a joint between the USB-C plug and the PCB.

6. The USB-C plug of claim 3, wherein the housing comprises a first plurality of contact separators arranged between at least a first portion of the first set of surface mount contact points, and a second plurality of contact separators arranged between at least a second portion of the second set of surface mount contact points.

7. The USB-C plug of claim 6, wherein the first plurality of contact separators do not extend to the first side of the outer portion of the housing, and the second plurality of contact separators do not extend to second side of the outer portion of the housing.

8. The USB-C plug of claim 1, wherein a thickness of the pair of retention latches is greater than a thickness of the plurality of signal contacts, and the pair of retention latches are configured to provide at least 8 Newtons of spring tension on a receptacle to which the USB-C plug is connected.

9. The USB-C plug of claim 1, further comprising a removable cap inserted into the insertion end of the barrel, the removable cap providing a flat surface for a vacuum pick up tool to pick up the USB-C plug, and wherein the removable cap is configured to be removed from the USB-C plug after the USB-C plug is bonded to a printed circuit board (PCB).

10. A universal serial bus type-C (USB-C) device comprising a USB-C plug coupled to a printed circuit board (PCB) having a plurality of signal bonding pads and a pair of retention latch bonding pads, the USB-C plug comprising:

a barrel having an insertion end, a contact end opposite the insertion end, a pair of long sides between the contact end and the insertion end, a pair of short sides between the contact end and the insertion end, and a barrel direction extending from the contact end to the insertion end;

a plurality of signal contacts arranged within the barrel, along the pair of long sides of the barrel and substantially parallel to the barrel direction;

a pair of retention latches arranged within the barrel, each along a respective short side of the barrel and substantially parallel to the barrel direction; and a plurality of surface mount contact points, each connected to a respective one of the plurality of signal contacts, each connected to a respective one of the plurality of signal bonding pads on the PCB and each extending in a direction substantially perpendicular to the plurality of signal contacts; and a pair of retention latch contact points, each connected to a respective one of the pair of retention latches, each connected to a respective one of the pair of retention latch bonding pads on the PCB and each extending in a direction substantially perpendicular to the pair of retention latches.

11. The USB-C device of claim 10, further comprising a chip coupled to the PCB, wherein the chip is configured to output a one-time password, and the PCB is configured to transmit data signals through at least one of the signal contacts based on the one-time password output by the chip.

12. The USB-C device of claim 10, wherein the USB-C plug comprises a housing having a pair of long sides and a pair of short sides, wherein a first portion of the plurality of surface mount contact points extend out of a first of the pair of long sides of the housing and a second portion of the plurality of surface mount contact points extend out of a second of the pair of long sides of the housing.

13. The USB-C device of claim 12, wherein the PCB comprises at least two alignment holes, and the housing comprises at least two alignment pins extending from a bottom surface of the housing, the at least two alignment pins coupled to corresponding ones of the at least two alignment holes, wherein coupling the positions of the at least two alignment holes to the at least two alignment pins aligns the surface mount contact points to the signal bonding pads.

14. The USB-C device of claim 12, wherein the housing comprises a first plurality of contact separators arranged between at least a first portion of the first set of surface mount contact points, and a second plurality of contact separators arranged between at least a second portion of the second set of surface mount contact points.

15. The USB-C device of claim 14, wherein the first plurality of contact separators do not extend to the first of the pair of long sides of the housing, and the second plurality of contact separators do not extend to second of the pair of long sides of the housing.

16. The USB-C device of claim 10, wherein a thickness of the pair of retention latches is greater than a thickness of the plurality of signal contacts, and the pair of retention latches are configured to provide at least 8 Newtons of spring tension on a receptacle to which the USB-C plug is connected.

17. The USB-C device of claim 11, further comprising a touch sensor configured to detect a touch from a user, wherein the chip is configured to output the one-time password in response to the touch sensor detecting the touch.

* * * * *